US005427698A

United States Patent [19]

Hirokawa et al.

[11] Patent Number: 5,427,698

[45] Date of Patent: Jun. 27, 1995

[54] COATING COMPOSITION FOR LUBRICATION

[75] Inventors: Yoshiyuki Hirokawa; Isao Tonomura, both of Hikone; Hirohumi Michioka; Yoshio Fuwa, both of Toyota, all of Japan

[73] Assignees: Takata Corporation, Tokyo; Toyota Jidosha Kabushiki Kaisha, Toyota, both of Japan

[21] Appl. No.: 246,398

[22] Filed: May 18, 1994

Related U.S. Application Data

[63] Continuation-in-part of Ser. No. 50,983, Apr. 22, 1993, abandoned, which is a continuation-in-part of Ser. No. 657,371, Feb. 19, 1991, abandoned, which is a continuation-in-part of Ser. No. 444,196, Dec. 1, 1989, abandoned.

[30] Foreign Application Priority Data

Dec. 9, 1988 [JP] Japan ..... 63-311216

[51] Int. Cl.[6] ..... C10M 161/00

[52] U.S. Cl. ..... 252/12.4; 252/30

[58] Field of Search ..... 252/12.4, 30

[56] References Cited

U.S. PATENT DOCUMENTS

| | | | |
|---|---|---|---|
| 3,717,576 | 2/1973 | Hiratsuka . | |
| 3,808,130 | 4/1974 | Schiefer et al. | 252/12.4 |
| 4,329,238 | 5/1982 | Mitrofarova . | |
| 4,438,004 | 3/1984 | Meyers . | |
| 4,532,054 | 7/1985 | Johnson | 252/12.4 |
| 4,770,797 | 9/1988 | Syracyse . | |
| 4,945,126 | 7/1990 | Crosby et al. | 252/12 |

FOREIGN PATENT DOCUMENTS

| | | | |
|---|---|---|---|
| 55-157664 | 12/1980 | Japan . | |
| 59-18429 | 4/1984 | Japan . | |
| 61-60766 | 3/1986 | Japan . | |
| 1192738 | 8/1986 | Japan | 252/29 |
| 63-86764 | 4/1988 | Japan . | |
| 76044268 | 12/1991 | Japan . | |

OTHER PUBLICATIONS

Hawleys Condensed Chemical Dictionary, Eleventh Edition, p. 576, "graphite fiber", 1987.

*Primary Examiner*—Jerry D. Johnson
*Attorney, Agent, or Firm*—Kanesaka & Takeuchi

[57] ABSTRACT

A coating composition to be used for lubrication, which comprises a synthetic resin, a solid lubricant and a friction coefficient adjuster.

7 Claims, No Drawings

COATING COMPOSITION FOR LUBRICATION

CROSS REFERENCE TO RELATED APPLICATION

The application is a CIP application of Ser. No. 050,983 filed on Apr. 22, 1993, now abandoned which is a CIP application of Ser. No. 657,371 filed on Feb. 19, 1991, abandoned, which is a CIP application of Ser. No. 444,196 filed on Dec. 1, 1989, abandoned.

The present invention relates to a coating composition to be used for lubrication. In particular, it relates to a coating composition for lubrication which is capable of providing an optimum friction coefficient to places to which it is applied and, at the same time, is capable of lowering abrasion loss.

Lubricants are supplied to surfaces of machines, devices, etc., so as to protect their surfaces from seizure and abrasion loss by replacing the dry friction between two surfaces by fluid friction or boundary friction.

Among hitherto employed lubrication compositions are of coating type comprising synthetic resins and solid lubricants, such as those described, e.g., in Japanese Patent Application (Laid Open) Nos. 86,764/88; 157,664/80 and 200,463/82; and Japanese Patent Publication No. 1,314/80. Major objects of producing, and using, such lubrication compositions are, among others, as follows:

1) improvement of lubrication, namely, lowering of friction coefficient of sliding surfaces, and reduction of abrasion loss;
2) prevention of scuffing; and
3) improvement of corrosion resistance.

There are parts which must have a relatively high, but a moderate friction coefficient and, at the same time, a low friction loss. For example, if the friction coefficient between a belt and a pulley is too small, the belt will slip on the pulley. In the case where the friction coefficient between a bolt, screw or the like and a surface with which it contacts is too small, the bolt tends to become loose. In addition, clutch plates, friction discs of differential-limiting differential gears, etc., which are used under wet conditions, also require a high abrasion resistance and a moderately high friction coefficient.

When prior coating compositions are applied to parts which require a moderately high friction coefficient and a low abrasion loss, there will be resulted an undesirably low friction coefficient, although a low level of abrasion can be attained because of the characteristic mentioned in 1) above. In particular, when prior lubrication coating compositions are used for clutch plates, friction discs of differential-limiting differential gears, etc., which are used under wet conditions, the friction coefficient between their sliding surfaces becomes too low [friction coefficient ($\mu$) will be around 0.05], and hence the frictional force necessary for the transmission of torque will not be attained. Because of this, an increased number of friction plates is required, or an increased pressing load must be applied, so as to attain sufficient frictional force.

OBJECTS AND SUMMARY OF THE INVENTION

It is therefore an object of the present invention to provide a coating composition for lubrication which is capable of providing an appropriate level of friction coefficient ($\mu$=0.06 or above) and, at the same time, is capable of reducing abrasion loss.

It is another object of the present invention to provide a coating composition for lubrication which markedly improves sliding properties, frictional properties and lubricating properties of parts which are required to have a moderately high friction coefficient and a low abrasion loss, so as to secure the transmission of torque in differential-limiting differential gears, clutch discs, pulleys, etc. to be used in oil; or of parts, such as bolts, which are required to have a moderately high friction coefficient to prevent the loosening thereof.

There is provided by the present invention a coating composition for lubrication which comprises a synthetic resin, a solid lubricant and a friction coefficient adjuster.

The coating composition according to the present invention is imparted with excellent lubricating properties by a solid lubricant and, at the same time, its lubrication property is adjusted by a friction coefficient adjuster to a desired moderate level, without any impairement of its abrasion resistant properties.

DESCRIPTION OF THE PREFERRED EMBODIMENTS

The present invention will be explained hereinbelow in detail.

There is no particular restriction on synthetic resins to be used in the coating composition for lubrication according to the present invention. Any synthetic resins can be used, including thermosetting resins, cold setting resins and two-component curing resins. The resins can be either water miscible or oil miscible.

Specific examples of usable synthetic resins include epoxy resins, phenyl resins, amino resins, polyester-alkyd resins, polyurethane resins, vinyl resins, polyamide-imide resins and silicon resins.

These resins can be used either individually or in combination of two or more. To use a combination of an epoxy resin and an amino resin can be particularly preferable since excellent adhesion, corrosion resistance, oil resistance, etc. can be attained with regard to coated films formed therefrom. In this case, amino resins are used preferably in an amount of 20 to 100 parts by weight, per 100 parts by weight of epoxy resins.

Synthetic resins are used preferably in an amount of from 20 to 80% by weight, in particular, from 30 to 60% by weight, based on the total weight of the coating composition. When the amount of synthetic resins used is less than 20% by weight, insufficient adhesion, corrosion resistance, oil resistance, etc. will be resulted, whereas when it exceeds 80% by weight, it becomes difficult to control friction coefficient.

There are no particular restrictions on the kind of solid lubricants to be used. Examples of usable solid lubricants include sulfides, such as molybdenum disulfide and tungsten disulfide; fluorides, such as polytetrafluoroethylene and graphite fluoride; graphite; melamine-cyanuric acid addition products; and boron nitride. These solid lubricants can be used either individually or in combination of two or more. It can be particularly preferable to use a combination of a sulfide and a fluoride because of their excellent withstand load, fitting and feeling. In this case, fluorides are used preferably in an amount of ca. 50 to 200 parts by weight, per 100 parts by weight of sulfides.

Such solid lubricants are used preferably in an amount of 20 to 80% by weight, in particular, 30 to 60% by weight, based on the total weight of the coating composition. When the amount of solid lubricants incorporated is less than 20% by weight, there will be resulted insufficient withstand load, fitting and feeling. In the case where it exceeds 80% by weight, there will be resulted insufficient adhesion, corrosion resistance and oil resistance.

Examples of usable friction coefficient adjusters include carbon fibers; carbon black; silicon compounds, such as silicon dioxide, silicon carbide, silicon nitride and glass fibers; aluminum oxide; potassium titanate fibers; and cellulose fibers. These friction coefficient adjusters can be used either individually or in combination of two or more. In the present invention, it can be particularly preferable to use noncrystalline carbon fibers as a friction coefficient adjuster since the use of carbon fibers, i.e. carbon grade carbon fiber, can be highly effective not only in the adjustment of friction coefficient, but also in the enhancement of abrasion resistance. The noncrystalline carbon fiber does not have a three-dimensional regular crystal structure. Therefore, this carbon fiber is especially useful.

Friction coefficient adjusters, in the case where they are fibrous, preferably have a length of ca. 10 um to 1 mm and, when they are granular, preferably have a diameter of ca. 100 μm or less. The carbon grade carbon fiber, i.e. noncrystalline carbon fiber, used in the present invention is prepared by heating an acrylic fiber in an inert gas to 1,000°-1,500° C., or heating a pitch fiber in an inert gas to 1,000°-1,400° C. If the carbon fibers or the carbon grade carbon fiber are further heated about between 2,500 and 3,000° C., the carbon fibers become graphite fibers or graphite grade carbon fiber, which are not used in the invention.

Such friction coefficient adjusters are used preferably in an amount of 50% by weight or less, more preferably from 5 to 30% by weight, based on the weight of the coating composition prepared. When the amount of friction coefficient adjusters incorporated exceeds 50% by weight, there will be resulted low adhesiveness and corrosion resistance of the coated lubricant film, and its abrasion resistance will not be sufficiently improved.

The coating composition according to the present invention can be easily prepared, e.g., by mixing a synthetic resin with a solid lubricant at a prescribed ratio, and then incorporating thereinto a prescribed amount of a friction coefficient adjuster. In addition, its friction coefficient can be varied over a wide range by adjusting the ratio of the components, while maintaining the abrasion loss at a low level.

If desired, an appropriate amount of solvent can be used upon the mixing of a synthetic resin and a solid lubricant or after the mixing of the three components, so as to make their mixing easier and to adjust the viscosity of the composition to a level suited for use.

Any solvent can be used if it is capable of dissolving synthetic resins. Although the amount of solvents to be used varies depending on the viscosity and quantity of synthetic resins used, it can be preferable to use ca. 100 to 300 parts by weight of solvents, per 100 parts by weight of the composition. It is possible to use either one single solvent or a mixture of solvents. Specific examples of usable solvents include methyl ethyl ketone (M.E.K.), xylene, and the like.

If desired, in addition to the above three components, the coating composition according to the present invention can be additionally incorporated with various additives, including quality modifiers. In this case, the amount of the additional additives should be 20% by weight or less, based on the weight of the coating composition.

The coating composition according to the present invention makes it possible to form a lubrication film having a friction coefficient controlled to a relatively high level and at the same time having a markedly reduced abrasion loss.

Accordingly, sliding friction and lubrication properties of such parts as differential-limiting differential gears, clutch discs and pulleys—which require a low abrasion loss and, at the same time, a relatively high level of friction necessary to secure the transmission of torque—and of parts which require a moderately high friction coefficient that prevents loosening of bolts etc. can be markedly improved by using the coating composition according to the invention.

The present invention will further be explained hereinbelow by way of examples. It should however be noted that the scope of the present invention will by no means be limited to these.

EXAMPLES 1 TO 21 AND COMPARATIVE EXAMPLE 1

Coating compositions for lubrication were prepared by using materials shown in Table 1 in ratios given in Table 2.

To be more specific, 100 parts by weight of a synthetic resin is dissolved in 100 to 200 parts by weight of a solvent (M.E.K., xylene, or the like), and then a solid lubricant is added thereto. The resulting mixture is subjected to pulverization treatment by use of a ball mill, and a prescribed amount of friction coefficient adjuster is added thereto. The thus obtained mixture was stirred to give a sample of coating composition.

Samples of coating compositions obtained were applied to test pieces set forth below, and friction coefficient and abrasion loss were determined in the manner described below. Results obtained are shown in Table 2.

(1) Determination of Friction Coefficient

Friction coefficient was determined in the following manner, employing a tester, test pieces and test conditions described below.

To be more specific, a ring and a block are subjected to surface treatment to form thereon a film of zinc phosphate, and then a sample of a coating composition prepared as above was air-sprayed on its surface at a thickness of ca. 20 μm, and then the coated film was cured under conditions given in Table 2. Friction coefficient was determined by pressing, with a constant load, the coated surface of the block onto the coated surface of the ring, while rotating the ring at a constant speed. Friction coefficient (μ) changes as time goes by. Generally, friction coefficient increases linearly after starting measurement, and then becomes constant. Statical friction coefficient (μs) is determined at the top of a linear line of friction coefficient (μ) after starting measurement, and dynamic friction coefficient (μd) is determined at a value of friction coefficient (μ) when it becomes constant.

Upon the determination of friction coefficient, the surface of the ring not contacted with the block was either dipped or not dipped in an oil (mineral oil) used for differential-limiting differential gears.

Tester

FALEX #1, Ring and Block Test Machine [manufactured by Faville Le Vally Co. (ASTM D 2714)]

Test Pieces
Ring: SAE 4620 Steel, Hrc 58–63, 6–12 r.p.m.
Block: SAE 0–1 Steel, Hrc 58–63, 4–8 r.p.m.
Test Conditions
Load: 100 lbs
Rotation Speed: 30 r.p.m.

(2) Determination of Abrasion Loss

Friction Plate A was prepared by coating a coating composition on a surface of a steel plate in the same manner as in the above (1) Determination of Friction Coefficient. Friction Plate B (outer diameter, 120 mm; inner diameter, 100 mm; and thickness, 1.8 mm) was prepared from a quenched and tempered steel plate (made of JIS SK5M steel; hardness, HV 460) having a surface roughness of 0.5 μRa. Friction test was performed by using Friction Plate A in combination with Friction Plate B.

To be more specific, Friction Plate A was pressed with a load of 500 k.g.f. onto Friction Plate B, while rotating Friction Plate B at about 50 r.p.m. in an oil used for differential-limiting differential gears, and its abrasion loss (thickness of wearing) was measured after 200 hours.

It would be apparent from Table 2 that coating compositions for lubrication according to the invention have higher friction coefficients than the prior art composition (Comparative Example 1), and their friction coefficients can be varied over a wide range. In addition, their abrasion losses are extremely small. On the other hand, the prior composition (Comparative Example 1) has an excessively low friction coefficient and exhibits a large abrasion loss.

In addition, in the case of Comparative Example 1, the coated film wore to the extent that part of the base steel was exposed, whereas in the case where the coating compositions according to the present invention were used, the coated films remained almost completely.

In the test using the thrust tester performed in (2) Determination of Abrasion Loss, coating compositions according to the invention formed films having a statical friction coefficient (μs) smaller than dynamic friction coefficient (μd). It was also found that the coated films according to the invention effectively suppress the generation of noises owing to the stick slip phenomenon. On the other hand, in the case of the prior composition (Comparative Example 1), the μs of the coated film was almost equal to, or a little smaller than, its μd. In addition, its steel base was exposed during the test since the abrasion resistance of the coated film was not sufficiently high, and noises were generated owing to the stick slip phenomenon. In the present invention, since dynamic friction coefficient is larger than statical friction coefficient, stick slip is substantially prevented.

In comparative Example 2, graphite fiber (crystalline carbon fiber) having three-dimensional regular crystal structure is used instead of carbon fiber in Example 1, which is noncrystalline, i.e. it does not have a three-dimensional regular crystal structure. In comparative Example 2, abrasion loss is higher than Example 1, and dynamic friction coefficient is lower than statical friction coefficient. Namely, in comparative Example 2, wear resistance is not high and it cause stick slip.

In Table 1 are shown trade names and manufacturers of the components used in Comparative Example 1 and Examples 1 to 21. It should however be noted that the components used therein are just examples, and the actual practice of the invention is not limited to these.

TABLE 1

| | | |
|---|---|---|
| Resin | Epoxy Resin | [Epichlon 7050 manufactured by Dainippon Ink & Chemicals Co., Ltd.] [Epichlon 840 manufactured by Dainippon Ink & Chemicals Co., Ltd.] |
| | Amino Resin | [Beckamin P-138 manufactured by Dainippon Ink & Chemicals Co., Ltd.] |
| | Phenyl Resin | [Phenodur PR401 Hoechst Japan Co., Ltd.] |
| | Polyester-Alkyd Resin | [Bekkosol ER-3400-60 manufactured by Dainippon Ink & Chemicals Co., Ltd.] |
| | Polyurethane Resin | [Bahnok M-5350 manufactured by Dainippon Ink & Chemicals Co., Ltd.] |
| | Vinyl Resin | [Eslek BL-2 manufactured by Sekisui Chemical Industries Co., Ltd.] |
| | Polyamide-Imide Resin | [HI-400 manufactured by Hitachi Chemical Industries Co., Ltd.] |
| | Silicone Resin | [KR 282 manufactured by Shin-etsu Chemical Industries Co., Ltd.] |
| Solid Lubricant | Molybdenum Disulfide | [Technical Grade manufactured by Climax Molybdenum Co.] [Technical Fine Grademanufactured by Climax Molybdenum Co.] |
| | Polytetrafluoroethylene | [Fluon manufactured by Asahi Glass Co., Ltd.] |
| | Graphite | [SP-10 SP-10 manufactured by Japan Graphite Industries Co., Ltd.] |
| | Melamine-Cyanuric Acid Addition Product | [M.C.A. manufactured by Yuka Melamine Co., Ltd.] |
| | Boron Nitride | [Sho BN manufactured by Japan Graphite Co., Ltd.] |
| Friction Coefficient Adjuster | Carbon Fiber | [Kureka Chop M-1009S, M-101S or M-104T manufactured by Kureha Chemical Industries Co., Ltd.] |
| | Carbon Black | [Raven 1250 manufactured by Combia Carbon Japan Co., Ltd.] |
| | Silicon Dioxide | [AEROSIL 200 manufactured by Japan Aerosil Co., Ltd.] |
| | Aluminum Oxide | [Earth Alumina manufactured by Earth Pharmaceuticals Co., Ltd.] |
| | Potassium Titanate Fiber | [Tismo-D manufactured by Otsuka Chemicals Co., Ltd.] |
| | Cellulose Fiber | [Kimwipe S-200 manufactured by Jujo Kimberly Co., Ltd.] |

TABLE 2

| | Synthetic Resin | | | Solid Lubricant | | Friction Coefficient Adjuster | | Under Lubricant Oil | | | Under Dry Lubricant |
|---|---|---|---|---|---|---|---|---|---|---|---|
| | Type of Setting | Kind: Parts by weight | Amount Incorporated (% by weight) | Kind (Average particle size in μm): Parts by weight | Amount Incorporated (% by weight) | Kind (Average particle size in μm) | Amount Incorporated (% by weight) | Friction Coefficient (μs) | Friction Coefficient (μd) | Abrasion Loss (μm) | Friction Coefficient (μ) |
| Comparative Example 1 | Thermosetting (200° C., 30 min.) | Epoxy Resin: 100 Amino Resin: 80 | 40 | Molybdenum Disulfide (5.0):100 Polytetrafluoroethylene (5.0):100 | 60 | None | None | 0.058 | 0.050 | 16.5 | 0.120 |
| Example 1 | Thermosetting (200° C., 30 min.) | Epoxy Resin: 100 Amino Resin: 80 | 40 | Molybdenum Disulfide (5.0):100 Polytetrafluoroethylene (5.0):100 | 40 | Carbon Fiber Diameter: 14.5 Length: 90 | 20 | 0.095 | 0.105 | 4.0 | 0.217 |
| Example 2 | Thermosetting (200° C., 30 min.) | Epoxy Resin: 100 Amino Resin: 80 | 45 | Molybdenum Disulfide (5.0):100 Polytetrafluoroethylene (5.0):100 | 45 | Carbon Fiber Diameter: 14.5 Length: 90 | 10 | 0.091 | 0.101 | 6.5 | 0.199 |
| Example 3 | Thermosetting (200° C., 30 min.) | Epoxy Resin: 100 Amino Resin: 80 | 30 | Molybdenum Disulfide (5.0):100 Polytetrafluoroethylene (5.0):100 | 30 | Carbon Fiber Diameter: 14.5 Length: 90 | 40 | 0.096 | 0.103 | 10.5 | 0.201 |
| Example 4 | Thermosetting (200° C., 30 min.) | Epoxy Resin: 100 Amino Resin: 80 | 40 | Molybdenum Disulfide (1.0):100 Polytetrafluoroethylene (5.0):100 | 40 | Carbon Fiber Diameter: 14.5 Length: 90 | 20 | 0.071 | 0.080 | 4.2 | 0.173 |
| Example 5 | Thermosetting (200° C., 30 min.) | Epoxy Resin: 100 Amino Resin: 80 | 40 | Molybdenum Disulfide (5.0):100 Polytetrafluoroethylene (5.0):100 | 40 | Carbon Fiber Diameter: 14.5 Length: 130 | 20 | 0.082 | 0.090 | 4.3 | 0.195 |
| Example 6 | Thermosetting (200° C., 30 min.) | Epoxy Resin: 100 Amino Resin: 80 | 40 | Molybdenum Disulfide (5.0):100 Polytetrafluoroethylene (5.0):100 | 40 | Carbon Fiber Diameter: 18.0 Length: 370 | 20 | 0.097 | 0.105 | 4.2 | 0.210 |
| Example 7 | Thermosetting (200° C., 30 min.) | Epoxy Resin: 100 Amino Resin: 80 | 40 | Molybdenum Disulfide (5.0):100 Polytetrafluoroethylene (5.0):100 | 40 | Carbon Black (23.0) | 20 | 0.082 | 0.080 | 6.9 | 0.165 |
| Example 8 | Thermosetting (200° C., 30 min.) | Epoxy Resin: 100 Amino Resin: 80 | 45 | Molybdenum Disulfide (5.0):100 Polytetrafluoroethylene (5.0):100 | 45 | Silicon Dioxide (12 mμ) | 10 | 0.103 | 0.105 | 9.6 | 0.187 |
| Example 9 | Thermosetting (200° C., 30 min.) | Epoxy REsin: 100 Amino Resin: 80 | 40 | Molybdenum Disulfide (5.0):100 Polytetrafluoroethylene (5.0):100 | 40 | Aluminum Oxide (less than 60) | 20 | 0.076 | 0.075 | 10.1 | 0.161 |
| Example 10 | Thermosetting (200° C., 30 min.) | Epoxy Resin: 100 Amino Resin: 80 | 40 | Molybdenum Disulfide (5.0):100 Polytetrafluoroethylene (5.0):100 | 40 | Potassium Titanate Fiber Diameter: 0.2-0.5 Length: 10-20 | 20 | 0.072 | 0.070 | 8.9 | 0.150 |
| Example 11 | Thermosetting (200° C., 30 min.) | Epoxy Resin: 100 Amino Resin: 80 | 40 | Molybdenum Disulfide (5.0):100 Polytetrafluoroethylene (5.0):100 | 40 | Cellulose Fiber (Wood pulp) | 20 | 0.088 | 0.085 | 8.7 | 0.166 |

TABLE 2-continued

| | Synthetic Resin | | | Solid Lubricant | | Friction Coefficient Adjuster | | Under Lubricant Oil | | | Under Dry Lubricant |
|---|---|---|---|---|---|---|---|---|---|---|---|
| | Type of Setting | Kind: Parts by weight | Amount Incorporated (% by weight) | Kind (Average particle size in μm): Parts by weight | Amount Incorporated (% by weight) | Kind (Average particle size in μm) | Amount Incorporated (% by weight) | Friction Coefficient (μs) | Friction Coefficient (μd) | Abrasion Loss (μm) | Friction Coefficient (μ) |
| Example 12 | Thermosetting (200° C., 30 min.) | Vinyl Resin: 100 Amino Resin: 80 | 40 | Molybdenum Disulfide (5.0):100 Polytetrafluoroethylene (5.0):100 | 40 | Carbon Fiber Diameter: 14.5 Length: 90 | 20 | 0.099 | 0.105 | 4.9 | 0.210 |
| Example 13 | Cold Setting (Ordinary Temp., 4 hrs.) | Polyurethane Resin | 40 | Molybdenum Disulfide (5.0):100 Polytetrafluoroethylene (5.0):100 | 40 | Carbon Fiber Diameter: 14.5 Length: 90 | 20 | 0.088 | 0.095 | 5.3 | 0.199 |
| Example 14 | Two-Component Type (Ordinary temp., 1 hr) | Epoxy Resin | 40 | Molybdenum Disulfide (5.0):100 Polytetrafluoroethylene (5.0):100 | 40 | Carbon Fiber Diameter: 14.5 Length: 90 | 20 | 0.092 | 0.100 | 5.7 | 0.207 |
| Example 15 | Thermosetting (200° C., 30 min.) | Epoxy Resin: 100 Phenyl Resin: 80 | 40 | Molybdenum Disulfide (5.0):100 Polytetrafluoroethylene (5.0):100 | 40 | Carbon Fiber Diameter: 14.5 Length: 90 | 20 | 0.083 | 0.090 | 4.7 | 0.179 |
| Example 16 | Thermosetting (200° C., 30 min.) | Amino Resin: 100 Polyester-Alkyd Resin: 80 | 40 | Molybdenum Disulfide (5.0):100 Polytetrafluoroethylene (5.0):100 | 40 | Carbon Fiber Diameter: 14.5 Length: 90 | 20 | 0.089 | 0.095 | 5.9 | 0.188 |
| Example 17 | Thermosetting (250° C., 1 hr) | Polyamide-Imide Resin | 40 | Molybdenum Disulfide (5.0):100 Polytetrafluoroethylene (5.0):100 | 40 | Carbon Fiber Diameter: 14.5 Length: 90 | 20 | 0.072 | 0.080 | 6.3 | 0.156 |
| Example 18 | Thermosetting (200° C., 30 min.) | Silicon Resin | 40 | Molybdenum Disulfide (5.0):100 Polytetrafluoroethylene (5.0):100 | 40 | Carbon Fiber Diameter: 14.5 Length: 90 | 20 | 0.074 | 0.080 | 6.7 | 0.181 |
| Example 19 | Thermosetting (200° C., 30 min.) | Epoxy Resin: 100 Amino Resin: 80 | 40 | Molybdenum Disulfide (5.0):100 Polytetrafluoroethylene (5.0):100 Graphite (10.0): 30 | 40 | Carbon Fiber Diameter: 14.5 Lenght: 90 | 20 | 0.098 | 0.105 | 4.2 | 0.192 |
| Example 20 | Thermosetting (200° C., 30 min.) | Epoxy Resin: 100 Amino Resin: 80 | 40 | Molybdenum Disulfide (5.0):100 Melamine-Cyanuric Acid Addition Product (3.0):100 | 40 | Carbon Fiber Diameter: 14.5 Length: 90 | 20 | 0.102 | 0.100 | 5.3 | 0.204 |
| Example 21 | Thermosetting (200° C., 30 min.) | Epoxy Resin: 100 Amino Resin: 80 | 40 | Boron Nitride (2.0):100 Polytetrafluoroethylene (5.0):100 | 40 | Carbon Fiber Diameter: 14.5 Length: 90 | 20 | 0.094 | 0.100 | 4.9 | 0.199 |
| Comparative Example 2 | | | Same as Example 1 | | | Graphite Fiber (Crystalline Carbon Fiber) Diameter: 14.5 (μm) Length: 90 (μm) | 20 | 0.064 | 0.062 | 9.2 | 0.138 |

What is claimed is:

1. A coating composition for lubrication comprising 20 to 80% by weight of a synthetic resin, said synthetic resin being a member selected from the group consisting of epoxy resins, phenyl resins, amino resins, polyester-alkyd resins, polyurethane resins, vinyl resins, polyamide-imide resins and silicone resins, 20 to 80% by weight of a solid lubricant, said solid lubricant being formed of polytetrafluoroethylene and at least one of boron nitride and molybdenum disulfide, and 5 to 30% by weight of carbon grade carbon fiber prepared by heating acrylic fiber in an inert gas to 1,000°-1,500° C. or heating pitch fiber in an inert gas to 1,000°-1,400° C.

2. A composition as defined in claim 1, wherein said synthetic resin is a mixture of an epoxy resin and an amino resin, containing the latter in an amount of 20 to 100 parts by weight, per 100 parts by weight of the former.

3. A composition as defined in claim 1, wherein said carbon fibers have a length of 10 μm to 1 mm and a diameter of 10 to 50 μm.

4. A coating composition for lubrication consisting essentially of, 20 to 80% by weight of a synthetic resin, said synthetic resin being at least one member selected from the group consisting of epoxy resins, phenyl resins, amino resins, polyester-alkyd resins, polyurethane resins, vinyl resins, polyamide-imide resins and silicone resins, 20 to 80% by weight of a solid lubricant, said solid lubricant consisting essentially of polytetrafluoroethylene, and at least one of molybdenum disulfide and boron nitride, and 5 to 30% by weight of carbon grade carbon fiber prepared by heating acrylic fiber in an inert gas to 1,000°-1,500° C. or heating pitch fiber in an inert gas to 1,000°-1,400° C., said composition having abrasion loss less than 7.0 micrometer, said abrasion loss being measured by the step of coating the composition onto a friction plate, preparing a ring member having hardness of HV 460 and a surface roughness of 0.5 uRa, rotating the ring member at 50 r.p.m., pressing the friction plate with the composition onto the rotating ring member at 500 k.g.f. for 200 hours, and measuring thickness of wearing, dynamic friction coefficient of the coating composition being larger than statical friction coefficient thereof to decrease stick slip.

5. A composition as defined in claim 4, wherein said carbon fibers have length of 10 μm to 370 μm.

6. A coating composition for lubrication comprising, 20 to 80% by weight of a synthetic resin, said synthetic resin being a mixture of epoxy resin and amino resin mixed in a ratio of 100 parts by weight of epoxy resin and 20 to 100 parts by weight of amino resin, 20 to 80% by weight of a solid lubricant, said solid lubricant being formed of polytetrafluoroethylene and at least one of boron nitride and molybdenum disulfide, and 5 to 30% by weight of carbon grade carbon fiber, said carbon fiber having a length of 10 micrometer to 1 millimeter and a diameter of 10 to 50 micrometer and prepared by heating acrylic fiber in an inert gas to 1,000°-1,500° C. or heating pitch fiber in an inert gas to 1,000°-1,400° C., said composition having abrasion loss less than 7.0 micrometer, said abrasion loss being measured by the step of coating the composition onto a friction plate, preparing a ring member having hardness of HV 460 and a surface roughness of 0.5 uRa, rotating the ring member at 50 r.p.m., pressing the friction plate with the composition onto the rotating ring member at 500 k.g.f. for 200 hours, and measuring thickness of wearing, dynamic friction coefficient of the composition being larger than statical friction coefficient thereof to decrease stick slip.

7. A composition as defined in claim 6, wherein said carbon fibers have length of 10 μm to 370 μm.

* * * * *